US005266010A

United States Patent [19]

Tanaka et al.

[11] Patent Number: 5,266,010

[45] Date of Patent: Nov. 30, 1993

[54] METHOD AND APPARATUS FOR CONTROLLING HYDRAULIC PUMP

[75] Inventors: Masayuki Tanaka; Isao Murota; Kazuhito Nakai; Makoto Iga, all of Tokyo, Japan

[73] Assignee: Shin Caterpillar Mitsubishi LTD, Tokyo, Japan

[21] Appl. No.: 997,883

[22] Filed: Dec. 29, 1992

[30] Foreign Application Priority Data

Jun. 12, 1992 [JP] Japan ..... 4-194458

[51] Int. Cl.[5] ..... F04B 47/06

[52] U.S. Cl. ..... 417/14; 417/32; 417/53

[58] Field of Search ..... 417/14, 32, 53; 374/120

[56] References Cited

U.S. PATENT DOCUMENTS 4,220,010 9/1980 Mueller et al. ..... 417/32 X 4,904,161 2/1990 Kamide et al. ..... 417/22

FOREIGN PATENT DOCUMENTS

0277253B1 7/1992 European Pat. Off. .

59-37286 8/1982 Japan .

61-250388 11/1986 Japan ..... 417/14

63-154874 12/1986 Japan .

62-265481 11/1987 Japan .

*Primary Examiner*—Richard E. Gluck

*Attorney, Agent, or Firm*—Fish & Richardson

[57] ABSTRACT

A method for controlling a hydraulic pump included by an apparatus, comprises the steps of: measuring a circumferential atmospheric temperature of the apparatus, comparing the measured circumferential atmospheric temperature with a first temperature to judge as to whether the measured circumferential atmospheric temperature is higher than the first temperature or not, and decreasing an output of the hydraulic pump when the measured circumferential atmospheric temperature is judged to be higher than the first temperature.

20 Claims, 3 Drawing Sheets

METHOD AND APPARATUS FOR CONTROLLING HYDRAULIC PUMP

BACKGROUND OF THE INVENTION AND RELATED ART STATEMENT

The present invention relates to a method and device for controlling a hydraulic pump, more particularly, to a method and device for adjusting an output of the hydraulic pump.

In a conventional method for controlling a hydraulic pump, the output of the hydraulic pump is decreased from a rated output thereof when a temperature of an apparatus including the hydraulic pump driven by an internal combustion engine increases to more than a predetermined temperature.

OBJECT AND SUMMARY OF THE INVENTION

An object of the present invention is to provide a method and device for controlling a hydraulic pump, by which an output of the hydraulic pump can be decreased before an apparatus including the hydraulic pump becomes of an overheat condition.

According to the present invention, a method for controlling a hydraulic pump included by an apparatus, comprises the steps of:

measuring a circumferential atmospheric temperature of the apparatus, comparing the measured circumferential atmospheric temperature with a first temperature to judge as to whether the measured circumferential atmospheric temperature is higher than the first temperature or not, and decreasing an output of the hydraulic pump when the measured circumferential atmospheric temperature is judged to be higher than the first temperature.

According to the present invention, a device for controlling a hydraulic pump included by an apparatus, comprises:

measuring means for measuring a circumferential atmospheric temperature of the apparatus, comparing means for comparing the measured circumferential atmospheric temperature with a first temperature to judge as to whether the measured circumferential atmospheric temperature is higher than the first temperature or not, and decreasing means for decreasing an output of the hydraulic pump when the measured circumferential atmospheric temperature is judged to be higher than the first temperature.

In the present invention, since the output of the hydraulic pump is decreased when the measured circumferential atmospheric temperature is judged to be higher than the first temperature, a heat energy generated by the apparatus and changing according to the output of the hydraulic pump is decreased when a heat exchange energy between the apparatus and the circumferential atmosphere for cooling the apparatus is decreased by an increase of the circumferential atmospheric temperature. That is, the heat energy generated by the apparatus is decreased before the overheat of the apparatus caused by the heat energy generated by the apparatus.

DETAILED DESCRIPTION OF PREFERRED EMBODIMENTS

Figure 1:
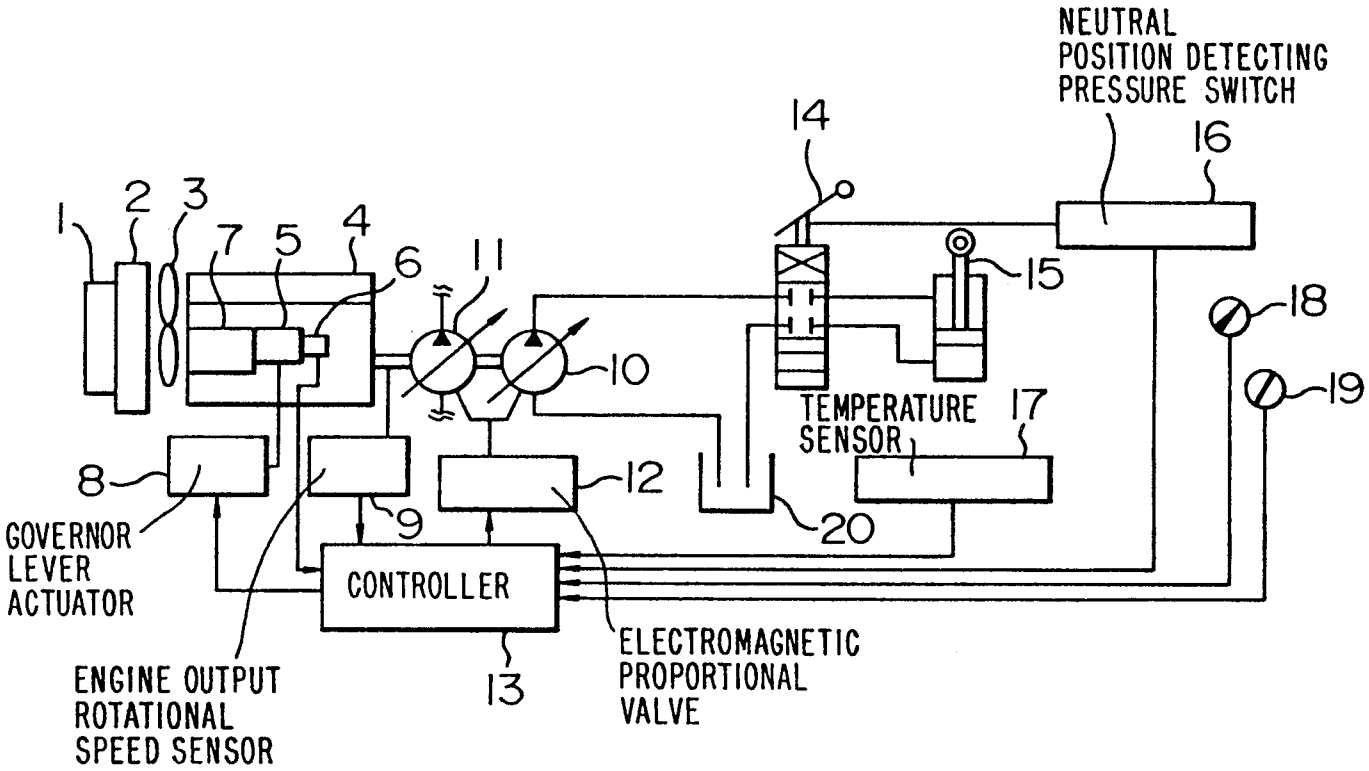
FIG. 1 is a schematic view showing an apparatus including a hydraulic pump, as an embodiment of the present invention.

As shown in FIG. 1, variable displacement (swashplate) or variable pressure hydraulic pumps 10 and 11 are driven by an internal combustion engine 4 into which a fuel is injected by a fuel injector 7, a flow rate of the fuel injected by the fuel injector 7 is adjusted according to a position of a governor lever (not shown) of a governor 5, an output rotational speed of the internal combustion engine 4 for operating the pumps 10 and 11 is changed according to the flow rate of the fuel injected by the fuel injector 7 and is measured by an engine output rotational speed sensor 9, the position of the governor lever is changed by a governor lever actuator 8 and is measured by a governor lever position sensor 6, a hydraulic oil is cooled by an oil cooler 1, a coolant for the internal combustion engine 4 is cooled by a radiator 2, and a fan 3 generates an air flow for accelerating heat exchanges between the atmosphere and the oil cooler 1 and between the atmosphere and the radiator 2 and for cooling the internal combustion engine 4. The output flow rate per rotation of each of the pumps 10, 11 and/or pressure of the hydraulic pumps 10 and 11 can be changed. An angle of the swash plate of the hydraulic pumps 10 and 11 is changed by a swash plate adjusting electro-magnetic proportional valve 12 to change the output flow rate per rotation of each of the pumps 10, 11. The output rotational speed of the internal combustion engine 4 may be changed to change the output flow rate of the pumps 10, 11.

A controller 13 receives a governor lever position signal from the governor lever position sensor 6, an engine speed signal from the engine output rotational speed sensor 9, an ambient temperature signal from an ambient temperature sensor 17 arranged in the neighborhood of an inlet of an engine intake air or of the radiator 2 or in a room containing the internal combustion engine 4 for measuring a temperature of the atmosphere surrounding this hydraulic system, a neutral position signal from a neutral position detecting pressure switch 16 for detecting a neutral position of an actuator control valve 14 instructing a hydraulic actuator 15 to stop, an accelerator position signal from an accelerator dial 18 for instructing the controller 13 how much a rated or predetermined output rotational speed of the internal combustion engine 4 is, and a power mode signal from a power mode indicator 19 for instructing the controller 13 whether the output flow rate per rotation of each of the pumps 10, 11 and/or pressure of the hydraulic pumps 10 and 11 should be decreased from a rated or predetermined or present value thereof according to the ambient temperature or the like. An excessive or drain hydraulic flow from the hydraulic pumps 10 and 11 and/or from the actuator control valve 14 is flow in a reservoir 20.

Figure 2:
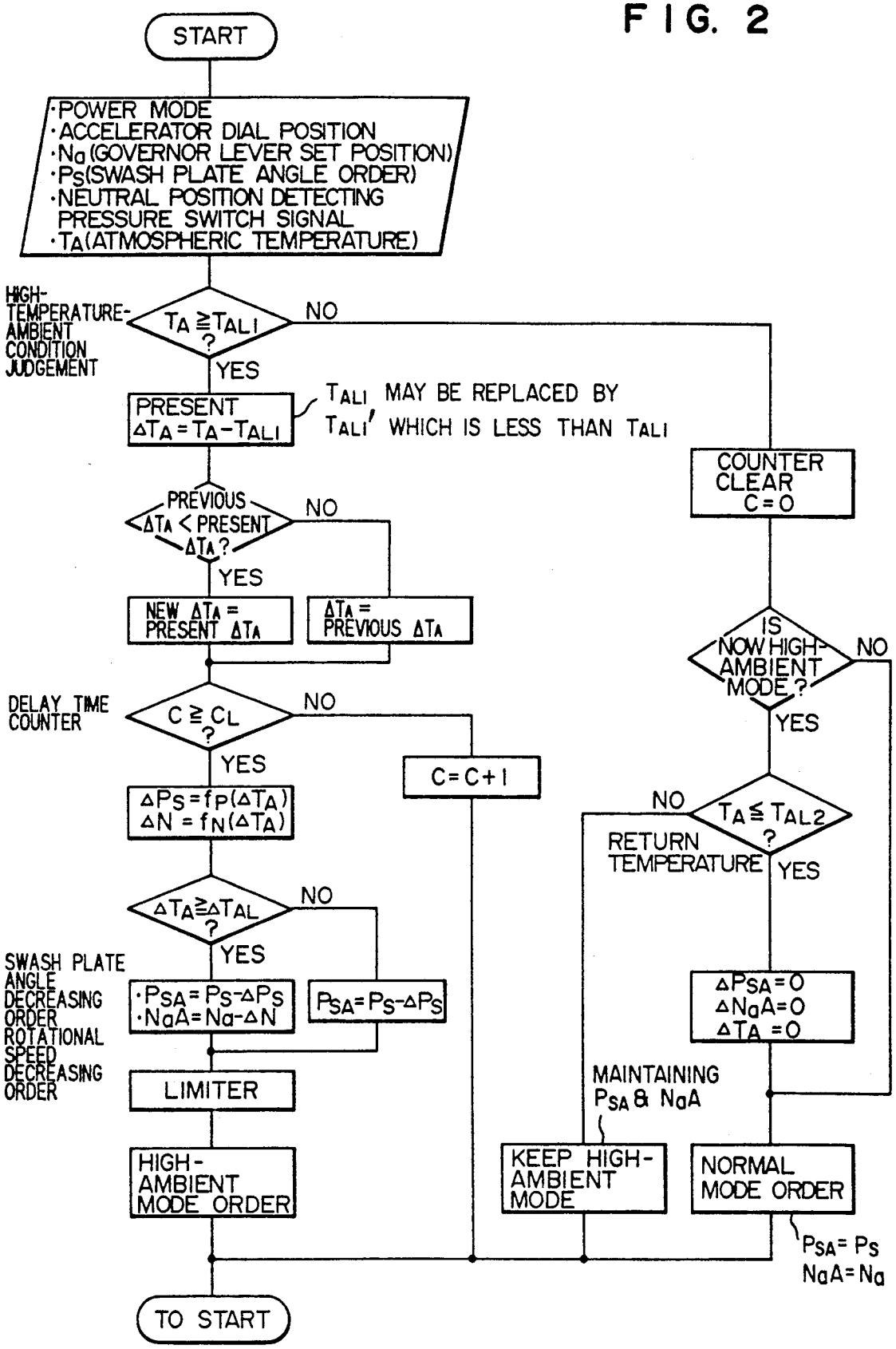
FIG. 2 is a flow chart showing a control method according to the present invention.

As shown in FIG. 2, when an operation of the hydraulic system is started, the governor lever position signal, the engine speed signal, the ambient temperature signal showing a temperature TA, the neutral position signal, the accelerator position signal, the power mode signal, a predetermined governor lever position signal Na instructing the internal combustion engine 4 to rotate at a rated or predetermined speed, and a predetermined pump output instruction signal Ps instructing the hydraulic pumps 10 and 11 to generate a rated or predetermined output flow rate per rotation of each of the pumps 10, 11 and/or pressure of the hydraulic pumps 10 and 11 are input into the controller 13. When the temperature TA is equal to or larger than a predetermined temperature level TAL1, a difference ΔTA between the temperature TA and the predetermined temperature level TAL1 is calculated. The difference ΔTA may be a difference between the temperature TA and a predetermined temperature level TAL1' less than the predetermined temperature level TAL1. When the present difference ΔTA which has been calculated is equal to or larger than a previous difference ΔTA which is already stored or recorded in the controller 13 before the present difference ΔTA has been calculated, the previously stored difference ΔTA is replaced by the present difference ΔTA so that the present difference ΔTA is stored or recorded in the controller 3 as the previous difference ΔTA. When the present difference ΔTA which has been calculated is less than the previous difference ΔTA which is already stored or recorded in the controller 3 before the present difference ΔTA has been calculated, the previously stored difference ΔTA is not replaced by the present difference ΔTA so that the previous difference ΔTA is maintained in the controller 3 as the previous difference ΔTA. Therefore, the maximum ΔTA after the temperature TA has become equal to or larger than the predetermined temperature level TAL1, is stored or recorded in the controller 3 as the previous difference ΔTA.

Subsequently, an elapsed time C after the temperature TA has become equal to or larger than the predetermined temperature level TAL1 is compared with a predetermined time CL. When the elapsed time C is equal to or larger than the predetermined time CL, a changing degree ΔPs for changing the output flow rate per rotation of each of the pumps 10, 11 and/or pressure of the hydraulic pumps 10 and 11 and a changing degree ΔN for changing the output rotational speed of the internal combustion engine 4 are calculated from the stored difference ΔTA on the basis of respective formulas Fp and Fn which may be linear functionals or nonlinear step functionals. When the elapsed time C is less than the predetermined time CL, the elapsed time C is increased by 1 and a normal operation mode is maintained, in which mode a pump control signal Psa for controlling the output flow rate per rotation of each of the pumps 10, 11 and/or pressure of the hydraulic pumps 10 and 11 is equal to a pump rated operation signal Ps for instructing the pumps 10, 11 to output a rated or predetermined output flow rate per rotation of each of the pumps 10, 11 and/or pressure of the hydraulic pumps 10 and 11, and a governor lever control signal NaA for controlling the output rotational speed of the internal combustion engine 4 is equal to the predetermined governor lever position signal Na for instructing the internal combustion engine 4 to rotate at the rated or predetermined speed.

Figure 4:
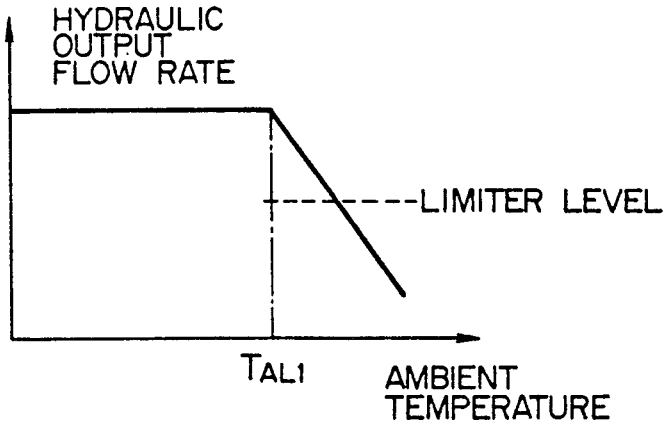
FIG. 4 is a diagram showing a relation between the measured atmospheric temperature and an output of the hydraulic pump whose lowest level is limited.

When the stored difference ΔTA is equal to or larger than a predetermined level ΔTAL, the pump control signal Psa for controlling the output flow rate per rotation of each of the pumps 10, 11 and/or pressure of the hydraulic pumps 10 and 11 is decreased from the pump rated operation signal Ps for instructing the pumps 10, 11 to output a rated or predetermined output flow rate per rotation of each of the pumps 10, 11 and/or pressure of the hydraulic pumps 10 and 11 by the changing degree ΔPs so that the output flow rate per rotation of each of the pumps 10, 11 and/or pressure of the hydraulic pumps 10 and 11 is decreased according t the changing degree ΔPs, and the governor lever control signal NaA for controlling the output rotational speed of the internal combustion engine 4 is decreased from the predetermined governor lever position signal Na instructing the internal combustion engine 4 to rotate at the rated or predetermined speed by the changing degree ΔN so that the output rotational speed of the internal combustion engine 4 is decreased according to the changing degree ΔN. When the stored difference ΔTA is less than the predetermined level ΔTAL, only the pump control signal Psa for controlling the output flow rate per rotation of each of the pumps 10, 11 and/or pressure of the hydraulic pumps 10 and 11 is decreased from the pump rated operation signal Ps for instructing the pumps 10, 11 to output the rated or predetermined output flow rate per rotation of each of the pumps 10, 11 and/or pressure of the hydraulic pumps 10 and 11 by the changing degree ΔPs so that the output flow rate per rotation of each of the pumps 10, 11 and/or pressure of the hydraulic pumps 10 and 11 is decreased according to the changing degree ΔPs. A minimum degree of each of the pump control signal Psa and the governor lever control signal NaA, that is, a minimum degree of each of the output flow rate per rotation of each of the pumps 10, 11 and/or pressure of the hydraulic pumps 10 and 11 and the output rotational speed of the internal combustion engine 4 is limited by a limiter circuit, as shown in FIG. 4.

Figure 3:
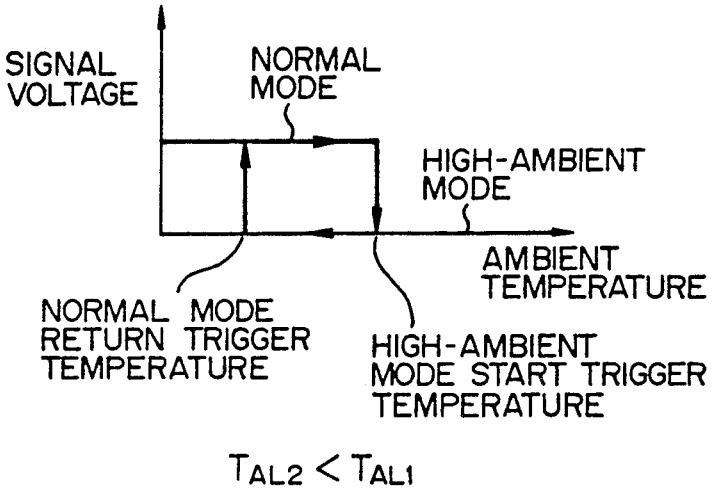
FIG. 3 is a diagram showing a relation between the measured atmospheric temperature and signals instructing a decreased output of the hydraulic pump and instructing a rated output of the hydraulic pump.

When the temperature TA is less than the predetermined temperature level TAL1, the elapsed time C is made zero. At this time, if the output flow rate per rotation of each of the pumps 10, 11 and/or pressure of the hydraulic pumps 10 and 11 is not decreased according to the changing degree ΔPs and the output rotational speed of the internal combustion engine 4 is not decreased according to the changing degree ΔN, the normal operation mode is maintained, in which mode the pump control signal Psa for controlling the output flow rate per rotation of each of the pumps 10, 11 and/or pressure of the hydraulic pumps 10 and 11 is equal to the pump rated operation signal Ps for instructing the pumps 10, 11 to output the rated or predetermined output flow rate per rotation of each of the pumps 10, 11 and/or pressure of the hydraulic pumps 10 and 11, and the governor lever control signal NaA for controlling the output rotational speed of the internal combustion engine 4 is equal to the predetermined governor lever position signal Na for instructing the internal combustion engine 4 to rotate at the rated or predetermined speed. At this time, if the output flow rate per rotation of each of the pumps 10, 11 and/or pressure of the hydraulic pumps 10 and 11 is decreased according to the changing degree ΔPs or the output rotational speed of the internal combustion engine 4 is not decreased according to the changing degree ΔN, the temperature TA is compared with a predetermined temperature level TAL2 which is less than the predetermined temperature level TAL1 as shown in FIG. 3. When the temperature TA is larger than the predetermined temperature level TAL2, the pump control signal Psa and the governor lever control signal NaA are maintained so that the output flow rate per rotation of each of the pumps 10, 11 and/or pressure of the hydraulic pumps 10 and 11 continues to be decreased according to the changing degree ΔPs and the output rotational speed of the internal combustion engine 4 continues to be decreased according to the changing degree ΔN. When the temperature TA is less than or equal to the predetermined temperature level TAL2, the changing degree ΔPs, the changing degree ΔN and the stored difference ΔTA are made zero, and the normal operation mode is started, in which mode the pump control signal Psa for controlling the output flow rate per rotation of each of the pumps 10, 11 and/or pressure of the hydraulic pumps 10 and 11 is equal to the pump rated operation signal Ps for instructing the pumps 10, 11 to output the rated or predetermined output flow rate per rotation of each of the pumps 10, 11 and/or pressure of the hydraulic pumps 10 and 11, and the governor lever control signal NaA for controlling the output rotational speed of the internal combustion engine 4 is equal to the predetermined governor lever position signal Na for instructing the internal combustion engine 4 to rotate at the rated or predetermined speed.

What is claimed is:

1. A device for controlling a hydraulic pump comprising:

measuring means for measuring a circumferential atmospheric temperature of the apparatus, comparing means for comparing the measured circumferential atmospheric temperature with a first temperature to judge as to whether the measured circumferential atmospheric temperature is higher than the first temperature or not, and decreasing means for decreasing an output of the hydraulic pump when the measured circumferential atmospheric temperature is judged to be higher than the first temperature.

2. A device according to claim 1, wherein the output of the hydraulic pump is decreased by a degree corresponding to a difference between the measured circumferential atmospheric temperature and the first temperature.

3. A device according to claim 1, wherein the output of the hydraulic pump is decreased by a degree corresponding to a difference between the measured circumferential atmospheric temperature and a second temperature less than the first temperature.

4. A device according to claim 1, wherein the output of the hydraulic pump is decreased by a degree corresponding to a maximum difference between a reference temperature and the circumferential atmospheric temperature measured after the measured circumferential atmospheric temperature becomes higher than the first temperature.

5. A device according to claim 1, wherein the output of the hydraulic pump is decreased when a predetermined time is elapsed after the measured circumferential atmospheric temperature becomes higher than the first temperature.

6. A device according to claim 1, wherein the output of the hydraulic pump is decreased by decreasing an operation speed of the hydraulic pump.

7. A device according to claim 1, wherein the output of the hydraulic pump is decreased by decreasing an output flow rate per rotation of the hydraulic pump.

8. A device according to claim 1, wherein the output of the hydraulic pump is decreased by decreasing an operation speed of the hydraulic pump after the output of the hydraulic pump is decreased by decreasing an output flow rate per rotation of the hydraulic pump.

9. A device according to claim 1, wherein the output of the hydraulic pump is increased when the measured circumferential atmospheric temperature becomes lower than a third temperature less than the first temperature after the measured circumferential atmospheric temperature is judged to be higher than the first temperature and the output of the hydraulic pump is decreased.

10. A method for controlling a hydraulic pump comprising the steps of:

measuring a circumferential atmospheric temperature of the apparatus, comparing the measured circumferential atmospheric temperature with a first temperature to judge as to whether the measured circumferential atmospheric temperature is higher than the first temperature or not, and decreasing an output of the hydraulic pump when the measured circumferential atmospheric temperature is judged to be higher than the first temperature.

11. A method according to claim 10, wherein the output of the hydraulic pump is decreased by a degree corresponding to a difference between the measured circumferential atmospheric temperature and the first temperature.

12. A method according to claim 10, wherein the output of the hydraulic pump is decreased by a degree corresponding to a difference between the measured circumferential atmospheric temperature and a second temperature less than the first temperature.

13. A method according to claim 10, wherein the output of the hydraulic pump is decreased by a degree corresponding to a maximum difference between a reference temperature and the circumferential atmospheric temperature measured after the measured circumferential atmospheric temperature becomes higher than the first temperature.

14. A method according to claim 10, wherein the output of the hydraulic pump is decreased when a predetermined time is elapsed after the measured circumferential atmospheric temperature becomes higher than the first temperature.

15. A method according to claim 10, wherein the output of the hydraulic pump is decreased by decreasing an operation speed of the hydraulic pump.

16. A method according to claim 10, wherein the output of the hydraulic pump is decreased by decreasing an output pressure of the hydraulic pump.

17. A method according to claim 10, wherein the output of the hydraulic pump is decreased by decreasing an output flow rate per rotation of the hydraulic pump.

18. A method according to claim 10, wherein the output of the hydraulic pump is decreased by decreasing an operation speed of the hydraulic pump after the output of the hydraulic pump is decreased by decreasing an output flow rate per rotation of the hydraulic pump.

19. A method according to claim 10, wherein the output of the hydraulic pump is increased when the measured circumferential atmospheric temperatures becomes lower than a third temperature less than the first temperature after the measured circumferential atmospheric temperature is judged to be higher than the first temperature and the output of the hydraulic pump is decreased.

20. A method according to claim 10, wherein a minimum degree of the output of the hydraulic pump is limited when the measured circumferential atmospheric temperature is judged to be higher than the first temperature and the output of the hydraulic pump is decreased.

* * * * *